US009533314B2

(12) United States Patent
Davranche et al.

(10) Patent No.: US 9,533,314 B2
(45) Date of Patent: Jan. 3, 2017

(54) CAP FOR A DISPLAY

(75) Inventors: Franck Davranche, Mougins (FR); Michel Gschwind, Grasse (FR)

(73) Assignee: ARECO FINANCES ET TECHNOLOGIE—ARFITEC, Grasse (FR)

( * ) Notice: Subject to any disclaimer, the term of this patent is extended or adjusted under 35 U.S.C. 154(b) by 1067 days.

(21) Appl. No.: 13/257,190

(22) PCT Filed: Mar. 15, 2010

(86) PCT No.: PCT/FR2010/050457

§ 371 (c)(1),
(2), (4) Date: Nov. 23, 2011

(87) PCT Pub. No.: WO2010/106276

PCT Pub. Date: Sep. 23, 2010

(65) Prior Publication Data

US 2012/0067974 A1 Mar. 22, 2012

(30) Foreign Application Priority Data

Mar. 16, 2009 (FR) ..... 09 51659

(51) Int. Cl.
*B05B 1/20* (2006.01)
*A47F 7/00* (2006.01)
(Continued)

(52) U.S. Cl.
CPC ..... *B05B 1/202* (2013.01); *A47F 3/001* (2013.01); *A47F 3/0495* (2013.01);
(Continued)

(58) Field of Classification Search
CPC ..... B05B 1/202; B05B 17/06–17/0692; B05B 1/26; B05B 15/065; B05B 7/0012; A47F 7/0071; A47F 7/0078; A47F 3/0495; A47F 3/001
(Continued)

(56) References Cited

U.S. PATENT DOCUMENTS 1,598,996 A * 9/1926 Wheelock ..... 239/429
3,362,641 A * 1/1968 Barnes ..... 239/97
(Continued)

FOREIGN PATENT DOCUMENTS

DE 10 2007 009 331 A1 8/2008
FR 2 882 237 A1 8/2006
(Continued)

OTHER PUBLICATIONS

French Search Report issued in Application No. 0951659; Dated Nov. 20, 2009 (With Translation).
(Continued)

*Primary Examiner* — Arthur O Hall
*Assistant Examiner* — Cody Lieuwen
(74) *Attorney, Agent, or Firm* — Oliff PLC

(57) ABSTRACT

The invention relates to a plug for a display stand for produce, suitable for spraying drops of fluid onto the produce, the plug being suitable for being placed in a section member of such a display stand, and including:

at least one central recess; and in a side wall at least one orifice for spraying the fluid, the plug being shaped so as to be capable of having at least one degree of freedom to move relative to the section member.

19 Claims, 5 Drawing Sheets

(51) Int. Cl.

| | |
|---|---|
| ***B05B 15/06*** | (2006.01) |
| ***B05B 1/26*** | (2006.01) |
| ***B05B 7/00*** | (2006.01) |
| ***A47F 3/00*** | (2006.01) |
| ***A47F 3/04*** | (2006.01) |

(52) U.S. Cl.
CPC ..... *A47F 7/0078* (2013.01); *B05B 1/26* (2013.01); *B05B 7/0012* (2013.01); *B05B 15/065* (2013.01)

(58) Field of Classification Search
USPC ..... 239/200, 207, 397, 445, 552, 99, 487, 239/502, 102.2, 499, 518, 524, 589, 239/590–590.5; 312/115; 211/127.1; 62/247
See application file for complete search history.

(56) References Cited

U.S. PATENT DOCUMENTS 3,696,630 A * 10/1972 Bressickello ..... A01G 5/04 62/188
3,815,832 A * 6/1974 Floyd ..... 239/563
4,738,806 A * 4/1988 Noma ..... A47F 3/0495 261/81
4,914,339 A 4/1990 Hayman, Jr. et al.
5,651,502 A * 7/1997 Edwards ..... 239/450
5,740,970 A 4/1998 Edwards
6,651,901 B2 * 11/2003 Jones ..... 239/99

FOREIGN PATENT DOCUMENTS

WO WO 98/02251 A1 1/1998
WO WO 02/36041 A1 5/2002

OTHER PUBLICATIONS

Written Opinion of the International Searching Authority issued in Application No. PCT/FR2010/050457; Dated Oct. 26, 2009 (With Translation).
International Search Report issued in Application No. PCT/FR2010/050457; Dated Oct. 26, 2009 (With Translation).

* cited by examiner

A-A

B-B

CAP FOR A DISPLAY

FIELD OF THE INVENTION

The present invention relates to a plug for a display stand for produce.

BACKGROUND OF THE INVENTION

A produce display stand is already known that enables fine droplets of water to be sprayed onto the produce it contains, the produce being constituted by fruit and vegetables, for example.

Present display stands comprise a section member frame including in particular a horizontal top bar that is pierced and through which droplets of water are diffused onto the produce.

Removable plugs of plastics material are put into place in the openings so as to prevent fluid from leaving them when the type of produce stored in the display stand, or its arrangement, does not require droplets of water to be sprayed via the openings.

Such plugs are put into place by hand by operators during installation of the display stand, which operation is not very practical and is relatively lengthy. They are also easily lost whenever there is no need for them to be in place on the display stand, which can be inconvenient during a subsequent change of the configuration of the display stand.

OBJECT AND SUMMARY OF THE INVENTION

An object of the invention is to remedy those drawbacks.

To this end, the invention provides a plug for a display stand for produce, the stand being suitable for spraying drops of fluid onto the produce, the plug being suitable for being put into place relative to a section member of such a display stand, wherein the plug includes:

at least one central recess; and in a side wall, at least one orifice for spraying fluid, the plug being shaped to possess at least one degree of freedom to move relative to the section member when it is put into place relative thereto.

In this way, the plug is movable relative to the display stand between at least two positions: a position in which the orifice in the plug and the opening in the display stand, as formed in the section member, are in alignment so as to allow droplets of water to be diffused onto the produce, and a position in which the orifice in the plug is offset from the opening in the section member, in which case the plug closes the opening, with fluid diffusion not taking place at this location of the display stand. The plug thus forms a diffuser plug that also serves to allow or prevent the passage of fluid.

By means of such a plug, it is easy to close a given opening in the display stand, i.e. to prevent any fluid passing therethrough, and the operator can install the display stand more easily and more quickly and/or can modify its configuration.

In addition, the plug may already be in place on the display stand when it is delivered. There is no need for it to be separated from the section member in order to be able to close the various openings in the display stand or in order to make them operational once more. There is thus no risk of the plug being lost.

The fluid sprayed onto the produce is constituted by drops of fluid. In fact, it comprises a mist, i.e. a mixture of gas, in particular air, and drops of liquid, in particular water. The pressure of such a mist is relatively low and it should be observed that a plug that is suitable for allowing or preventing the spraying of liquid on its own, at high pressure, might not be suitable when the fluid is constituted by such a mist.

Furthermore, by means of the invention, it is possible to vary the flow rate of fluid that escapes through each of the openings of the display stand, in particular by causing the openings in the display stand to overlap the orifices in the plug in a partial manner.

The plug of the invention may also include one or more of the characteristics in the following list:

- the plug is in the form of a cylindrical body of revolution. This makes it possible to move it merely by turning it, from the closure position to the fluid-spraying position, and relative to a section member that is likewise cylindrical;
- the plug is dimensioned so that the side wall surrounds the section member and is placed inside the section member. When the plug is placed inside the section member, the appearance of the display stand may also be improved;
- the plug is closed at one of its longitudinal ends, thereby enabling the section member to be closed when the plug is in place therein, and thus avoiding fluid leakage and increasing the quantity of fluid that is sprayed out from the section member via the orifices;
- the plug includes means for positioning the plug relative to the section member and suitable for giving the plug at least one degree of freedom to move relative to the section member;
- in particular, the positioning means comprise a shoulder suitable for co-operating with a complementary shoulder of the section member. The positioning means may in particular comprise a shoulder placed between a closed end of the plug and the orifice, the shoulder being suitable for co-operating with an edge of the section member. Such a plug is of simple design and allows the plug to be moved easily. It is suitable for example for openings that are placed at the longitudinal ends of the section member;
- in a variant, the positioning means comprise at least one peg projecting from the side wall and suitable for being placed in a slot in the section member. The peg may then slide in the slot between the closure position and the spraying position. Depending on requirements, the slot in the section member may extend in the longitudinal direction of the section member, in its transverse direction, or in a direction that is inclined relative to those two directions;
- the positioning means comprise at least one projection and/or depression suitable for co-operating with a complementary depression and/or projection of the section member. This constitutes another variant of the embodiment described above;
- the plug has a plurality of orifices that are distributed irregularly in its side wall, thereby enabling the adjustment of closure to be optimized, e.g. making it possible to close one, two, or three openings in the section member using the same plug, when the section member has a plurality of openings suitable for being covered by the plug;
- the plug has two recesses that are separated by a wall, e.g. extending over the entire longitudinal dimension of the plug, the orifice being arranged in a portion of the side wall that defines a first recess, the plug being closed at a longitudinal end in its portion forming the first recess. Thus, the plug has two portions: an open portion at both ends proving a bypass for the fluid and allowing it to reach the opening in the section member situated downstream from the opening that can be closed by the plug, without the flow therethrough being disturbed by fluid being sprayed through the plug, and a closed second portion in which the fluid is directed to the outside via the openings in the section member, thereby facilitating passage of the fluid through the openings in the section member. This is particularly advantageous when the section member is constituted by a vertical pole; and the plug includes means for guiding fluid towards the orifice in order to facilitate fluid spraying. In particular, the orifice is formed by a channel arranged in the wall of the plug, the channel being of constant section and of longitudinal direction that is inclined relative to the normal of the side wall of the plug. The plug shapes may also be optimized using design software so that the flow minimizes head losses in the fluid. This is particularly advantageous for directing streams of fluid droplets towards produce when the openings are placed in a vertical pole. The guide means may also include a point extending into the recess, preferably at the center of the recess, projecting from a closed longitudinal end of the plug.

The invention also provides an assembly comprising a display stand and a plug of the invention, the display stand having at least one section member including at least one opening in a side wall, the plug being suitable for being put into place relative to the section member in such a manner that the orifice therein is in register with the opening in the section member.

The plug has a degree of freedom to move relative to the section member, such that its orifice can be offset relative to the opening in the section member, in order to enable the plug to close the opening in the section member, i.e. prevent the fluid from passing through the opening.

Optionally, the section member of the assembly further includes an elongate slot suitable for co-operating with the peg of the plug, the slot extending in the longitudinal direction of the section member and/or in its transverse direction. It may also include a rim suitable for co-operating with a shoulder of the plug.

The section member may also include at least one projection and/or depression suitable for co-operating with a complementary depression and/or projection of the section member.

Preferably, the section member is constituted by a pole that is essentially vertical, even though the invention can naturally be adapted to section members having an arbitrary orientation, e.g. horizontal. The diffusion of drops through openings placed in a vertical pole presents numerous advantages.

Firstly, such an arrangement makes it possible to obtain a display stand that is more attractive in performance, the presence of a top horizontal bar on the display stand not being essential. In addition, this is more practical and less expensive for display stands that present a plurality of levels.

In addition, such a display stand is less expensive to manufacture since it need not include a horizontal top bar. This is also advantageous since the fluid flowing in the section member follows a path that is shorter and less disturbed and is therefore subjected to less head loss.

Under such circumstances, the section member may also include at least two sections, the diameter of an upper section being smaller than the diameter of a lower section, thereby facilitating good diffusion of the fluid in the pole.

The section member may also include a normal wall that is oriented downwards through which the opening is arranged, thereby contributing to facilitating diffusion of fluid towards the produce.

The invention also provides a display stand having means for generating fluid drops, such as an ultrasound generator, and an essentially vertical pole pierced by openings for spraying drops out from the pole, and presenting the above-described advantages.

The display stand may include one or more of the characteristics of the assembly.

BRIEF DESCRIPTION OF THE DRAWINGS

The invention can be better understood on reading the following description given purely by way of example and made with reference to the drawings, in which.

MORE DETAILED DESCRIPTION

Figure 1:
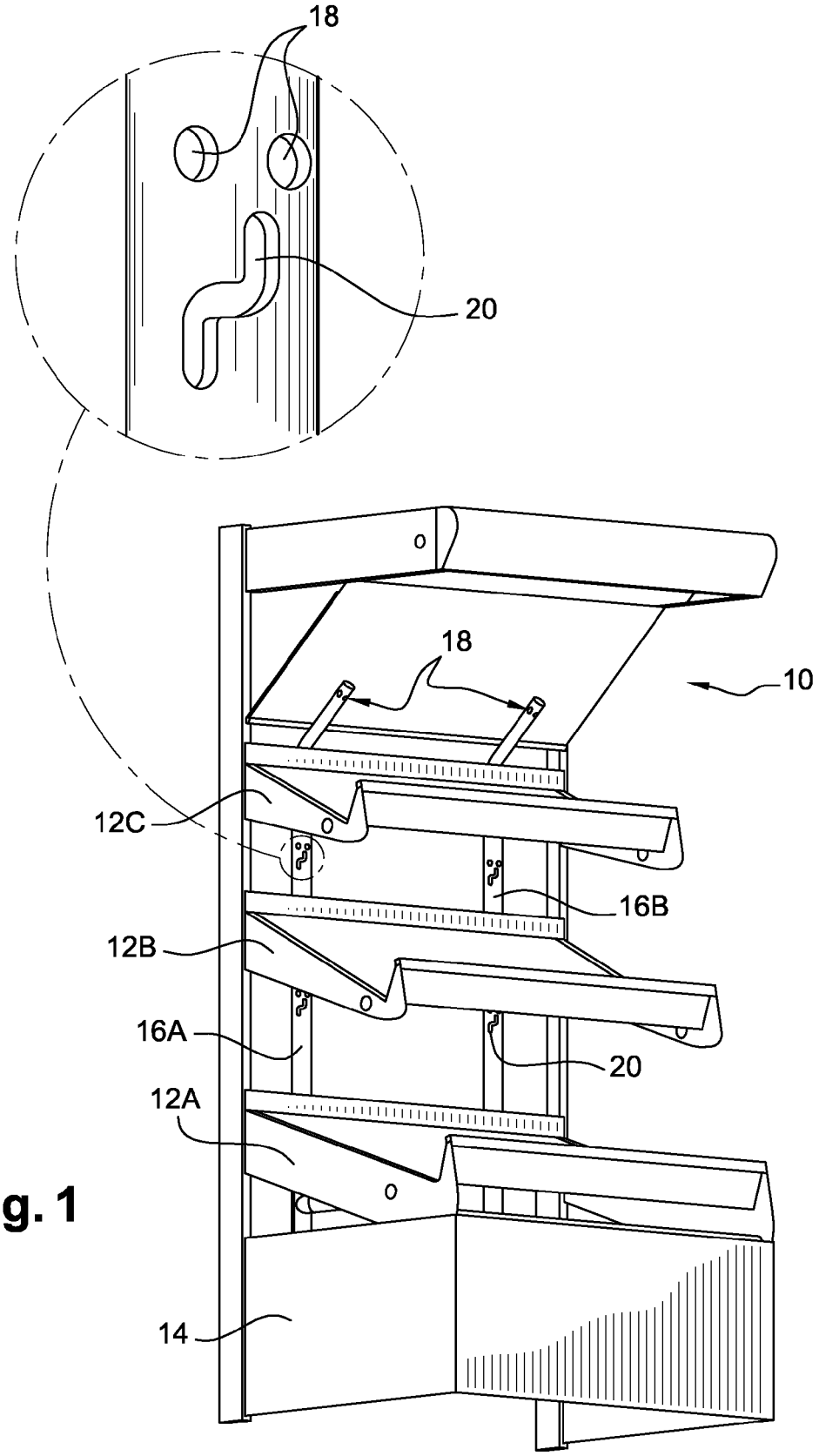
FIG. 1 is a perspective view of a display stand suitable for spraying fine droplets of fluid on the produce it contains.
Figure 2:
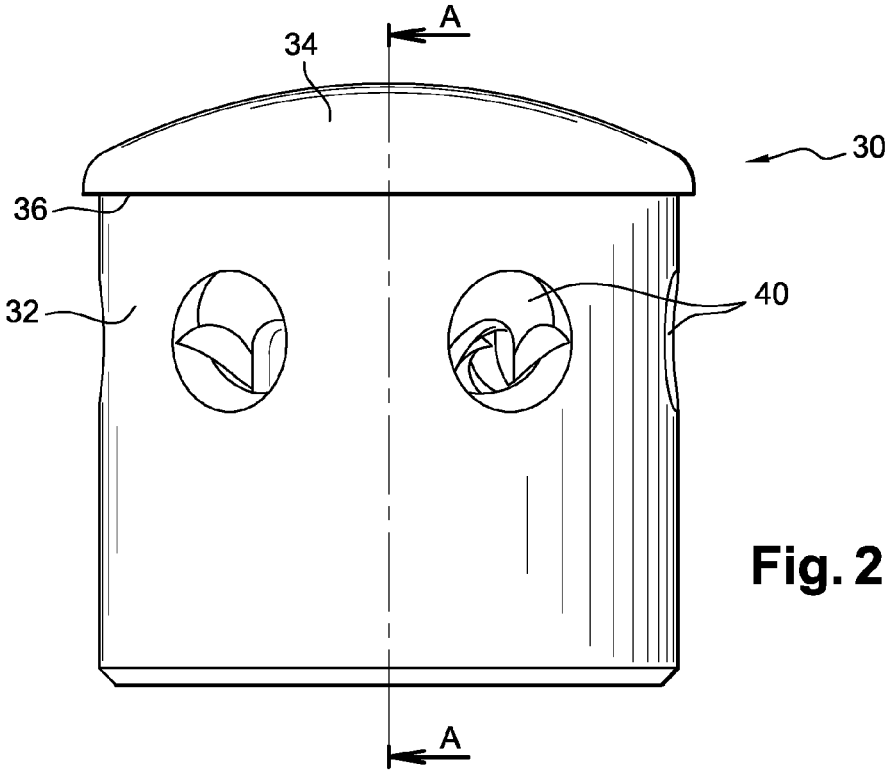
FIG. 2 is a side view in perspective of a plug in a first embodiment of the invention.

FIG. 1 shows a display stand 10 for fresh produce, in particular fruit and vegetables. The display stand has three superposed shelves 12A, 12B, and 12C for supporting the produce and a bottom cabinet 14 that is to house a generator for generating fine droplets (not visible in the figure), such as an ultrasound generator.

The display stand also has two poles 16A and 16B that are essentially vertical and bent at their top ends. The poles 16A and 16B are hollow section members made of metal, e.g. sheet metal, and they are circularly cylindrical. They have openings 18 formed in their side walls, two openings per pole being placed above a given shelf. The poles 16A, 16B also include slots, one slot per pole being placed above each of the lower shelves 12A, 12B, and visible in FIG. 1.

Each pole with the associated openings 18 is connected to the generator and serves to diffuse water in the state of fine droplets produced by the generator onto the produce supported by the shelves 12A, 12B, 12C. In order to enable the water to be diffused in the state of fine droplets, a mist of water, i.e. a mixture of gas and of water, is created by the generator and flows inside the section member.

Each slot 20 has two end portions extending in the transverse direction of the section member, and a middle portion extending in the longitudinal direction of the section member. Nevertheless, the slot could extend solely in the longitudinal direction or in the transverse direction of the section member.

There follows a description with reference to the figures of a plug 30 in a first embodiment of the invention, such a plug being designed to be placed in pole 16A, 16B at its top end.

The plug 30 comprises a cylindrical body of revolution 32 of dimensions suitable for enabling it to be inserted in the section member 16A, 16B. It is closed at its top longitudinal end by a cover 34 formed integrally with the body 32.

The plug 30 is mushroom-shaped, and more particularly it includes a shoulder 36 separating the body 32 from the cover 34. The shoulder is suitable for co-operating with a rim at the top end of the pole 16A, 16B. It forms means for positioning the plug 30 in the pole 16A, 16B.

Figure 3:
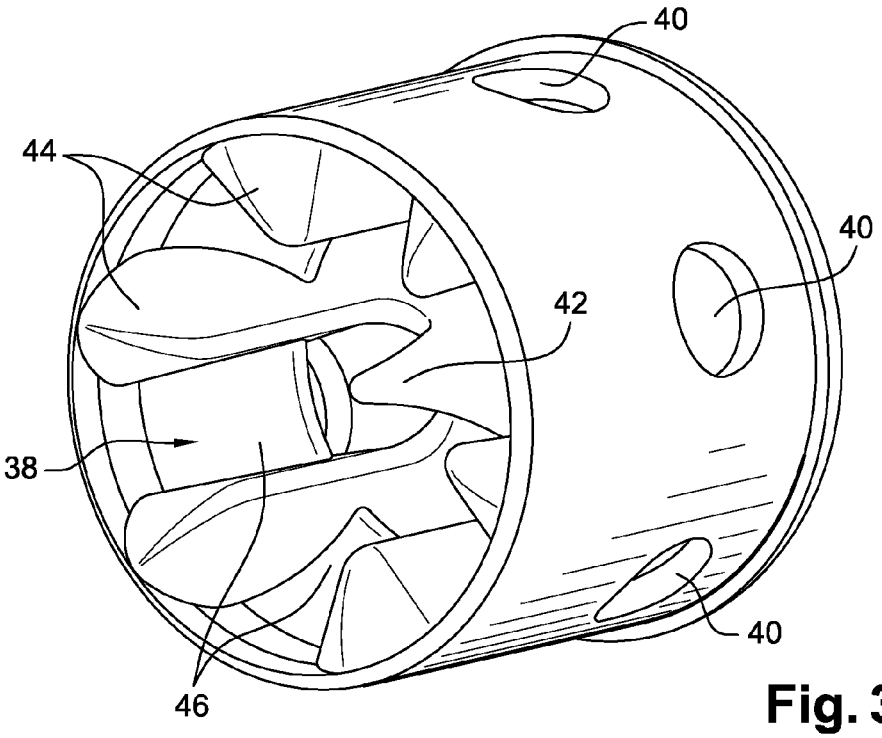
FIG. 3 is a bottom view in perspective of the FIG. 2 plug.

The body 32 also includes a central recess 38, as can be seen better in FIG. 3, that is closed at its end by the cover 34. This recess 38 is defined by a side wall that is pierced by a plurality of orifices 40. These orifices are placed in the plug 30 in such a manner as to be capable of being aligned with the corresponding openings 18 in the pole 16, as can be seen in FIG. 4.

The recess 38 allows fluid to pass through the plug, and the orifices 40 are in fluid communication with said recess 38, enabling the fluid to be sprayed to the outside.

When the operator seeks to close the top openings 18 in the pole 16A, 16B, e.g. when the top shelf is empty, it suffices to turn the plug by means of its cover 34 so that the shoulder 36 slides on the rim of the pole 16A, 16B and so that the side wall of the plug, in its portion that does not include the orifices 40, is placed in register with the openings in the pole 16A, 16B. The plug thus possesses a degree of freedom to move relative to the section member 16A, 16B. The plug may naturally take up positions other than the closure position and the position in which the orifices in the plug are in register with the openings in the section member.

Figure 4:
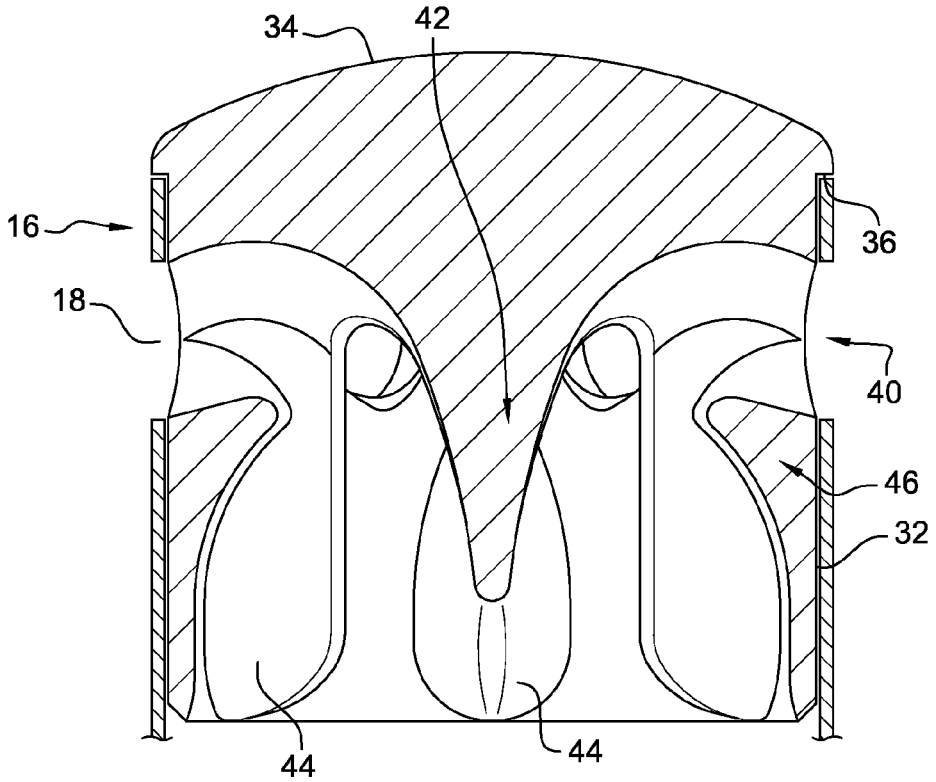
FIG. 4 is a section view on A-A of the FIG. 2 plug when in place in the FIG. 1 display stand.

As can be seen more particularly in FIGS. 3 and 4, the recess 38 in the plug is of a special shape. A central point 42 extends from the cover 34 into the recess 38 so as to separate the fluid flow and direct the resulting flow towards the various orifices 40. In addition, the plug has internal fluting 44 extending over the inside surface of the side wall of the plug. The fluting extends in the longitudinal direction of the plug, over the portions of the side wall that do not include orifices 40.

In addition, in its portion situated immediately below an orifice 40, the side wall has an extra thickness 46. Thus, by means of the central point 42 and the extra thickness 46, each orifice 40 is formed by a channel of constant section but of longitudinal direction that is inclined relative to the normal to the side wall of the plug. This enables the flow of fluid to be directed downwards more easily when the plug is in place in the pole, and enables the effectiveness with which the fluid is diffused to be increased, the produce then receiving more water for a given quantity of water that is sprayed. The means 42 to 46 constitute fluid guide means.

In the example described, the inside shape of the plug serves to transform the speed of the fluid along the longitudinal direction of the section member into radial speed without loss of speed, and possibly even with an increase of speed, and without head loss.

The plug is made of a plastics material, e.g. by laser sintering, and it is engaged by force inside the pole 16 so that it cannot be removed from the section member unintentionally.

Figure 5:
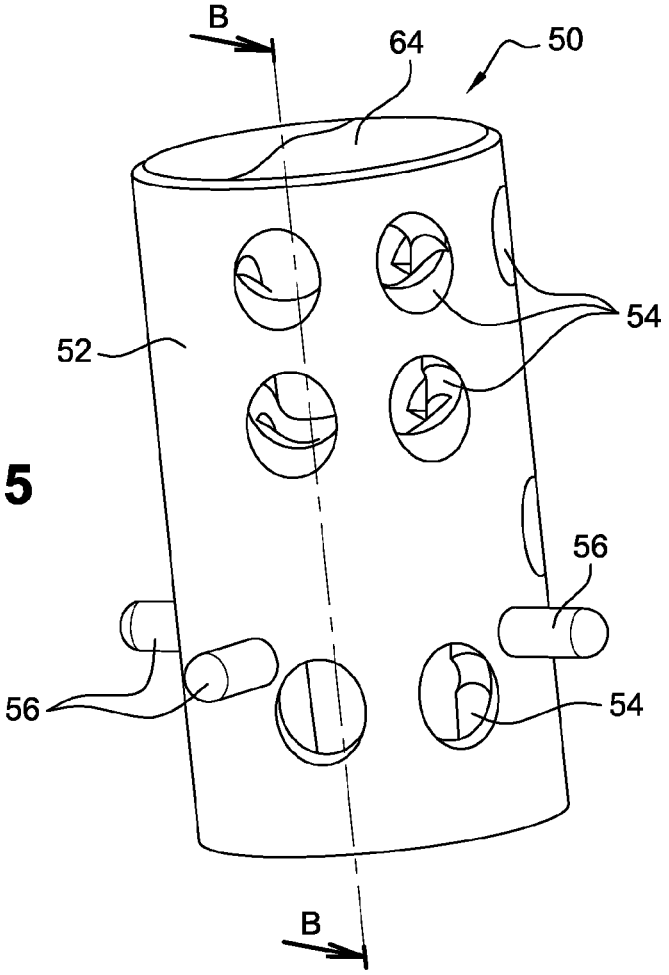
FIG. 5 is a side view in perspective of a plug in a second embodiment of the invention.
Figure 6:
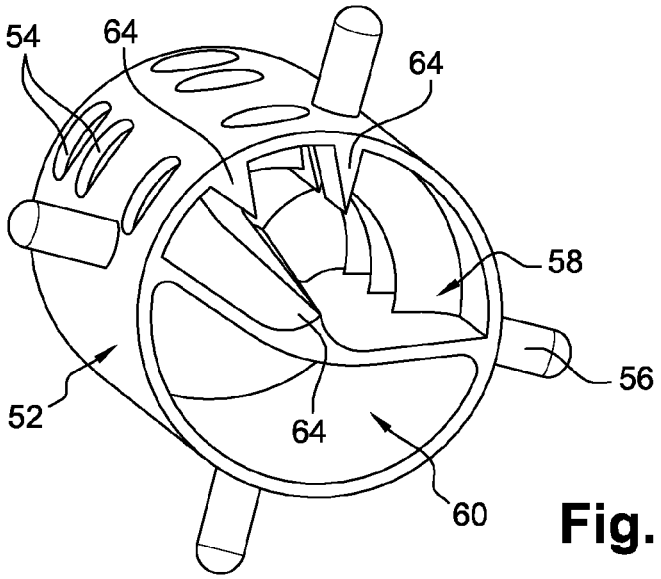
FIG. 6 is a bottom view in perspective of the FIG. 5 plug.
Figure 7:
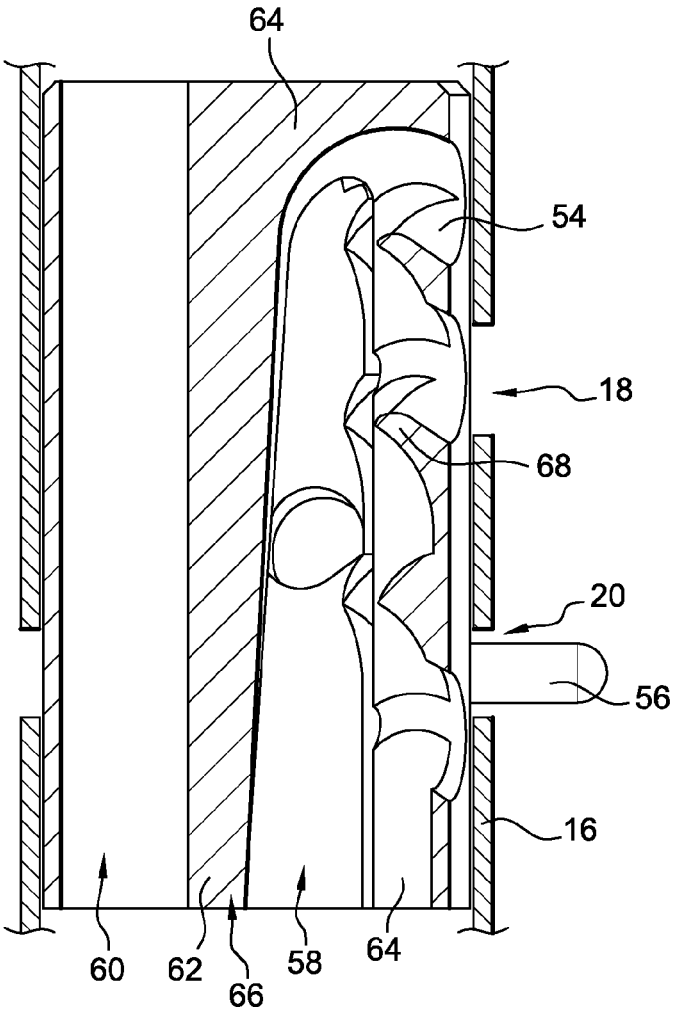
FIG. 7 is a section view on B-B of the FIG. 5 plug when it is in place in the FIG. 1 display stand.

With reference to FIGS. 5 to 7, there follows a description of a plug 50 in a second embodiment. This plug is suitable for being placed inside the pole 16A, 16B level with the openings 18 situated above the bottom shelves 12A and 12B.

The plug 50 is essentially in the form of a cylindrical body of revolution. It has a side wall 52 pierced by orifices 54. The plug also has a plurality of pegs 56 projecting from the side wall and forming means for positioning the plug 50. Each peg is dimensioned so as to be placed in a slot 20 of the pole 16.

The orifices 54 are located in the plug 50 so as to be capable of being put into alignment with the corresponding openings 18 in the pole 16 when a peg is placed in the corresponding slot 20, as shown in FIG. 7.

The pegs 56 are constituted by cylindrical elements of transverse dimensions that are essentially equal to the transverse dimensions of the slot 20. The plug is held in position inside the pole by the peg co-operating with the slot, such a peg passing through the slot, as can be seen in FIG. 7. In contrast, the longitudinal dimension of the slot is greater than the transverse dimension of the slot, so the peg can therefore slide along the slot 20.

The slot is more particularly shaped so that the peg 56 can slide between a position in which the orifices 54 are placed facing the openings 18 in the pole 16A, 16B so that the fluid can be sprayed out from the pole, and a position in which the orifices are offset relative to the openings 18 in the pole 16A, 16B so that the fluid can not be sprayed out from the pole.

More particularly, when the peg is placed in a first end portion of the slot, the plug is in a fluid-spraying position, and when it is in the other portion, the plug is in a closure position. The plug may also occupy positions other than those described above, thereby enabling the way in which the fluid is diffused.

The plug thus has two degrees of freedom to move relative to the pole 16 since it can move in translation and in rotation relative to the longitudinal axis of the section member, inside the section member, along the path that is defined by the slot. The slot 20 and the peg 56 thus forms means for positioning the plug inside the pole 16, enabling the plug to take up a plurality of positions relative to the pole.

As can also be seen in FIG. 7, the plug 50 includes two recesses 58, 60 in its central portion, which recesses are separated by a middle wall 62 extending along the entire longitudinal dimension of the plug.

The first recess 58 is defined by the side wall portion 52 having the orifices 54 and it is covered by a ceiling 64 at one longitudinal end. The second recess 60 is in the form of a duct of constant section and it is open at both longitudinal ends of the plug. The second recess 60 forms a bypass duct for allowing fluid to flow towards the upper openings 18.

As can be seen in FIGS. 6 and 7, the first recess 58 also includes fluting 64 on the inside face of its side wall 52, the fluting being situated between the orifices 54. The middle wall 62 also includes a projection 66 extending along the entire longitudinal dimension of the plug. Just like the plug 30, the plug 50 includes portions of extra thickness 68 situated under each orifice 54. Thus, by means of the projection 66 and the portions of extra thickness 68, each orifice 54 is formed by a channel of constant section but of longitudinal direction that is inclined relative to the normal to the side wall of the plug. Thus, the projection 66 and the portions of extra thickness 68 form means for guiding the fluid flow so as to direct the fluid towards the produce.

Figure 8:
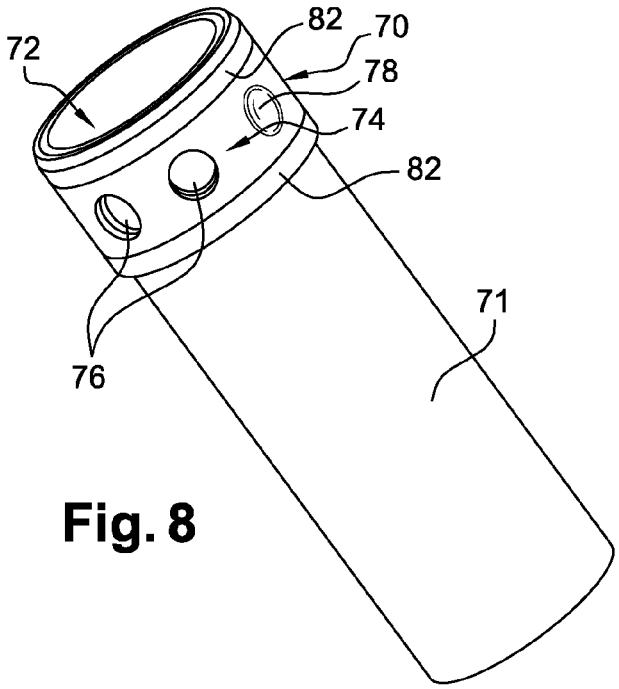
FIG. 8 is a perspective view of a plug in a third embodiment of the invention, put into place on a section member of the FIG. 1 display stand.

FIG. 8 also shows a plug 70, but in another embodiment of the invention, the plug 70 being put into place on a section member 71.

Here the plug 70 is in the form of a cylindrical ring for placing around the section member. In its central portion it has a recess 72 of dimensions suitable for receiving the section member, with the side wall 74 thereof surrounding the section member and it includes in said side wall 74 orifices 76 for spraying fluid onto the produce.

The plug 70 is designed to be placed on the section member 71 so that the orifices 76 can be put into register with the openings in the section member.

When the plug is in the spraying position and the user desires to move the plug, e.g. to the closure position, it suffices to turn the plug about an axis that coincides with the axis of the section member and of the plug. It is then possible to adjust the position of the plug relative to the section member as a function of the amount of closure desired.

The plug also includes, in its side wall 74, shallow depressions 78. These depressions have a purely ergonomic function, forming a grip zone for the operator to facilitate turning the plug around the section member.

In this embodiment, the orifices 74 are not distributed regularly around the plug. This makes it possible with a single plug to close differing numbers of openings in the section member as a function of the position of the plug relative to the section member, so as to handle different requirements.

The plug is suitable for being held around the vertical section member by abutments 82 forming a bearing that prevents the plug from moving in translation along the longitudinal axis of the section member.

It should be observed that the invention is not restricted to the embodiments described.

The plug may have any shape other than those described. For example, it may be of square section. The number of orifices in the plug is not limited to the numbers described. The shape of the orifices is likewise not limited to the shapes described: the orifices may be in the form of slots, e.g. chamfered slots extending in the longitudinal, transverse, or diagonal direction through the side wall of the plug. The orifices may be of a shape that is even more complex. For example, each orifice may be in the form of a U-shaped slot.

The positioning means are not limited to those described. For example, they could be constituted by means that do not require contact, such as magnets. The pegs such as those described could also be removable (e.g. being screwed or pressed into orifices provided for this purpose in the walls), thereby making it easier to install the plug in the section member. Furthermore, the plug may include at least one projection and/or depression co-operating with at least one complementary depression and/or projection of the section member, these projections and depressions possibly forming fluting extending in the longitudinal direction or in a direction that is inclined relative to the longitudinal direction of the section member. The plug may also include an inclined shoulder extending over the entire perimeter of the plug, so as to form a helical shoulder, suitable for co-operating with a complementary shoulder of the section member, so as to enable the shoulder of the plug to slide on the shoulder of the section member.

The plug may also include motor-driven means for moving the plug between its closure position and its fluid spraying position.

The fluid-guide means are also optional. The plug could therefore have only one of the elements selected from the fluting, the central point, and the portions of extra thickness, or indeed none of them. The channels may also be of any shape other than that described, for example the longitudinal direction of a channel need not be a straight line. The guide means are not limited to the above description, and the inside shapes of the plug, and the diameters of the various sections could vary as a function of the desired spraying of fluids.

Similarly, the plug could additionally be open at both longitudinal ends. It could also include a plurality of portions instead of being made as a single piece, for example the inside wall or the longitudinal end could be separate from the side wall and could engage therein, thereby making the plug easier to fabricate.

It should also be observed that the number of orifices in the plug need not always correspond to the number of openings at the same level in the section member that are covered by the plug. The plug may have a number of orifices that is greater than the number of openings in the section member, the orifices being distributed over the plug so that an opening in the section member can be superposed on two or three orifices in the plug, thus making it possible to set up variants concerning the way in which fluid is diffused onto the produce.

The display stand could also include numbers of shelves and/or poles that are different from those described. The section members may also extend in a direction that is horizontal or that is inclined relative to the vertical. In addition, the poles may coincide with the legs of the display stand, thereby avoiding the need for the display stand to have extra section members. Under such circumstances, the section members need to be dimensioned so as to be relatively rigid in spite of having openings therein, since they then form portions of the structure of the display stand.

Figure 9:
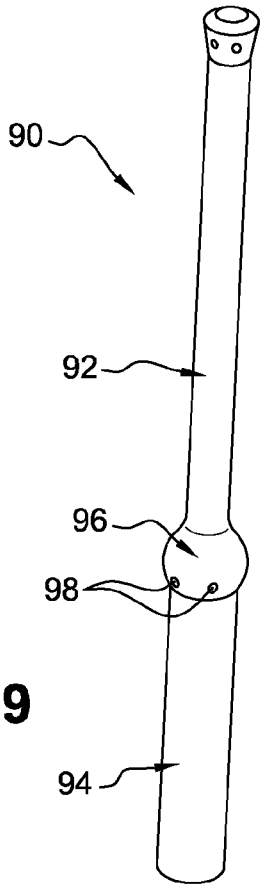
FIG. 9 is a perspective view of a variant of a section member for the FIG. 1 display stand.

The shape of a pole is not limited to that described. As can be seen in FIG. 9, the pole 90 is of diameter that is not constant. By way of example, it may have a top section 92 and a bottom section 94 that are of distinct diameters, the top section 92 being of smaller diameter than the bottom section 94. This makes it possible to increase pressure inside the pole at each change of diameter, thereby encouraging good spraying of the fluid, even though the upper orifices.

The pole 90 also includes an essentially spherical shape 96 between its two sections 92 and 94. Fluid spraying orifices 98 are formed in this shape 96, in the bottom portion thereof. Since the normal to the side wall of this portion having the shape 96 faces downwards, that facilitates spraying of the fluid in a downward direction towards the shelves. The shape of the plug is then naturally modified accordingly.

Such a pole may optionally include a bend, like the bend in the pole of FIG. 1.

The pole may also be square in section, for example, or it may include some number of openings that is different from that described.

The openings may be differently distributed along the pole. The pole preferably has five openings each having a section of 10 square millimeters, per square meter of display stand, in order to optimize the spraying of fluid onto the produce. Nevertheless, this value may vary as a function of parameters of the display stand, for example the pressure of the fluid.

Furthermore, the shape of the openings is not limited to that described above. The openings may also be constituted, for example, by slots of any shape or by channels arranged in the wall of the section member and of longitudinal direction that is inclined relative to the radial direction of the section member.

The shape of the slots in the section member is likewise not limited to the above description, when the section member includes such slots. For example, the slots may extend in a direction that is inclined relative to the longitudinal and transverse directions of the section member.

What is claimed is:

1. A misting device comprising:

a display stand for produce, the misting device being configured to spray a mist on the produce;

a section member of the display stand, the section member including at least one opening formed in a side wall of the section member;

a plug configured to be placed relative to the section member; and a generator configured to generate the mist within the generator, the generator being located away from the plug and being arranged to flow the mist through the section member, wherein the plug is shaped such that the plug has at least one degree of freedom relative to the section member when the plug is placed relative to the section member, the plug further includes:

at least one central recess, in a plug side wall, at least one orifice for spraying fluid through the opening of the side wall of the section member, and a plurality of internal fluting extending into the at least one central recess over the plug side wall.

2. The misting device according to claim 1, wherein the plug is a shape of a cylindrical body of revolution.

3. The misting device according to claim 1, wherein the plug is dimensioned so that the plug side wall surrounds the section member and is placed inside the section member.

4. The misting device according to claim 1, wherein the plug further includes a shoulder configured to: (i) position the plug relative to the section member, and (ii) give the plug at least one degree of freedom to move relative to the section member.

5. The misting device according to claim 4, wherein the shoulder cooperates with a complementary shoulder of the section member.

6. The misting device according to claim 4, wherein the shoulder includes at least one projection or depression that cooperates with a complementary depression or projection of the section member.

7. The misting device according to claim 4, wherein the shoulder includes at least one peg projecting from the plug side wall and being placed in a slot in the section member.

8. The misting device according to claim 1, wherein the plug further includes at least two recesses that are separated by a wall, the orifice being formed in a portion of the plug side wall that defines a first recess, the plug being closed at a longitudinal end in its portion forming the first recess.

9. The misting device according to claim 1, wherein the plug further includes a central point configured to guide fluid towards the orifice.

10. The misting device according to claim 9, wherein the orifice is formed by a channel arranged in the wall of the plug, the channel being of constant section and of longitudinal direction that is inclined relative to the normal to the wall.

11. The misting device according to claim 9, wherein the central point extends into the recess, preferably in the center of the recess, projecting from a closed longitudinal end of the plug.

12. The misting device according to claim 1, the plug being configured to be inserted into the section member such that the orifice is in register with the opening in the section member.

13. The misting device according to claim 7, the plug being configured to be inserted into the section member such that the orifice is in register with the opening in the section member, the slot extending in a longitudinal direction of the section member or in a transverse direction.

14. The misting device according to claim 6, the plug being configured to be inserted into the section member such that the orifice is in register with the opening in the section member.

15. The misting device according to claim 12, wherein the section member is an essentially vertical pole.

16. A misting device comprising:

a display stand for produce, the misting device being configured to spray a mist on the produce;

a section member of the display stand;

a plug configured to be placed relative to the section member; and a generator configured to generate the mist, the generator being located away from the plug, wherein the plug is shaped such that the plug has at least one degree of freedom relative to the section member when the plug is placed relative to the section member, the plug further includes:

at least one central recess, in a side wall, at least one orifice for spraying fluid, a central point extending into the central recess for separating the fluid flowing in the plug, and a plurality of internal fluting extending into the central recess over the side wall.

17. A misting device comprising:

a display stand for produce, the misting device being configured to spray a mist on the produce;

a section member of the display stand, the section member including at least one opening formed in a side wall of the section member;

a plug configured to be placed relative to the section member; and a generator configured to generate the mist, the generator being located away from the plug, wherein the plug is shaped such that the plug has at least one degree of freedom relative to the section member when the plug is placed relative to the section member, the plug further includes:

at least one central recess, in a plug side wall, at least one orifice for spraying fluid through the opening of the side wall of the section member, a deflecting surface extending into the central recess, and a plurality of internal fluting extending into the at least one central recess over the plug side wall.

18. A misting device comprising:

a display stand for produce, the misting device being configured to spray a mist on the produce;

a section member of the display stand;

a plug configured to be placed relative to the section member; and a generator configured to generate the mist, the generator being located away from the plug, wherein the plug is shaped such that the plug has at least one degree of freedom relative to the section member when the plug is placed relative to the section member, the plug further includes:

at least one central recess, in a side wall, at least one orifice for spraying fluid, and a plurality of internal fluting extending into the central recess over the side wall.

19. The misting device according to claim 1, wherein the generator is an ultrasonic generator.

* * * * *